US010184725B2

(12) United States Patent
Ishiguro et al.

(10) Patent No.: US 10,184,725 B2
(45) Date of Patent: Jan. 22, 2019

(54) INFRARED FURNACE AND METHOD FOR INFRARED HEATING

(71) Applicant: AISIN TAKAOKA CO., LTD., Toyota-shi, Aichi (JP)

(72) Inventors: Yuki Ishiguro, Toyota (JP); Katsunori Ishiguro, Toyota (JP)

(73) Assignee: AISIN TAKAOKA CO., LTD., Toyota-Shi, Aichi (JP)

( * ) Notice: Subject to any disclaimer, the term of this patent is extended or adjusted under 35 U.S.C. 154(b) by 52 days.

(21) Appl. No.: 14/765,414

(22) PCT Filed: Jan. 30, 2014

(86) PCT No.: PCT/IB2014/058653
§ 371 (c)(1),
(2) Date: Aug. 3, 2015

(87) PCT Pub. No.: WO2014/118722
PCT Pub. Date: Aug. 7, 2014

(65) Prior Publication Data

US 2015/0377555 A1 Dec. 31, 2015

(30) Foreign Application Priority Data

Feb. 1, 2013 (JP) ..... 2013-018876

(51) Int. Cl.
*F26B 3/30* (2006.01)
*F27D 11/12* (2006.01)
(Continued)

(52) U.S. Cl.
CPC ..... *F27D 11/12* (2013.01); *C21D 1/18* (2013.01); *C21D 1/34* (2013.01); *C21D 6/00* (2013.01);
(Continued)

(58) Field of Classification Search
None
See application file for complete search history.

(56) References Cited

U.S. PATENT DOCUMENTS 3,626,154 A 12/1971 Reed
4,229,236 A 10/1980 Heath
(Continued)

FOREIGN PATENT DOCUMENTS

CN 102132121 A 7/2011
CN 202517001 U 11/2012
(Continued)

OTHER PUBLICATIONS

Office Action (Notification of the First Office Action) dated Mar. 4, 2016, by the State Intellectual Property Office of People's Republic of China in corresponding Chinese Patent Application No. 201480007105.8, and an English Translation of the Office Action. (14 pages).
(Continued)

*Primary Examiner* — Thor Campbell
(74) *Attorney, Agent, or Firm* — Buchanan Ingersoll & Rooney PC

(57) ABSTRACT

The infrared furnace includes a plurality of infrared lamps arrayed on one surface side of a work and a reflective surface provided on its opposite surface side. Outputs of the infrared lamps are locally adjusted, or intensity of the infrared rays incident on one work surface is locally adjusted by a member disposed between the infrared lamps and the one surface of the work. In this manner, variations in strength may be imparted to one and the same car part.

9 Claims, 13 Drawing Sheets

(51) Int. Cl.

| | |
|---|---|
| ***F27B 9/06*** | (2006.01) |
| ***F27B 17/00*** | (2006.01) |
| ***F27D 99/00*** | (2010.01) |
| ***C21D 1/18*** | (2006.01) |
| ***C21D 1/34*** | (2006.01) |
| ***C21D 6/00*** | (2006.01) |
| ***F27D 19/00*** | (2006.01) |
| ***H05B 3/00*** | (2006.01) |

(52) U.S. Cl.
CPC ..... *F27B 9/066* (2013.01); *F27B 17/0016* (2013.01); *F27B 17/0075* (2013.01); *F27D 19/00* (2013.01); *F27D 99/0001* (2013.01); *H05B 3/0061* (2013.01); *F27D 2019/0034* (2013.01)

(56) References Cited

U.S. PATENT DOCUMENTS

| | | | | |
|---|---|---|---|---|
| 4,406,944 | A * | 9/1983 | Crain | H01L 27/013 219/388 |
| 4,477,718 | A * | 10/1984 | Crain | F27B 9/04 219/388 |
| 4,832,249 | A * | 5/1989 | Ehler | B23K 1/0053 219/411 |
| 7,978,964 | B2 * | 7/2011 | Ranish | H01J 65/00 392/407 |
| 8,582,962 | B2 * | 11/2013 | Ranish | H01J 65/00 392/407 |
| 8,847,126 | B2 * | 9/2014 | Ishiguro | C21D 1/09 219/600 |
| 8,983,280 | B2 | 3/2015 | Fujita et al. | |
| 2004/0112885 | A1 * | 6/2004 | Shigeoka | H01L 21/67115 219/388 |
| 2005/0074230 | A1 * | 4/2005 | Kamata | H01L 21/67109 392/420 |
| 2005/0191044 | A1 * | 9/2005 | Aderhold | F27B 17/0025 392/418 |
| 2009/0041443 | A1 * | 2/2009 | Aderhold | F27B 17/0025 392/411 |
| 2009/0289053 | A1 * | 11/2009 | Ranish | H01L 21/67115 219/522 |
| 2010/0074604 | A1 * | 3/2010 | Koelmel | H01L 21/67098 392/408 |
| 2011/0013892 | A1 * | 1/2011 | Ragay | H05B 3/0076 392/411 |
| 2011/0132897 | A1 | 6/2011 | Ishiguro et al. | |
| 2012/0076476 | A1 * | 3/2012 | Kusuda | F27B 17/0025 392/416 |
| 2012/0093492 | A1 * | 4/2012 | Kato | F27B 17/0025 392/411 |
| 2012/0288261 | A1 * | 11/2012 | Hashimoto | F27B 17/0025 392/416 |
| 2012/0328272 | A1 * | 12/2012 | Fujita | F26B 3/30 392/416 |
| 2014/0334806 | A1 * | 11/2014 | Ranish | H01L 21/67115 392/416 |

FOREIGN PATENT DOCUMENTS

| | | | |
|---|---|---|---|
| CN | 102860122 | A | 1/2013 |
| EP | 2 322 672 | A1 | 5/2011 |
| JP | 31-12580 | Y | 8/1956 |
| JP | 61-192526 | A | 8/1986 |
| JP | 61-246315 | A | 11/1986 |
| JP | 08-139047 | A | 5/1996 |
| JP | 2005-193287 | A | 7/2005 |
| JP | 2007-210027 | A | 8/2007 |
| JP | 2007-335344 | A | 12/2007 |
| JP | 2008-068282 | A | 3/2008 |
| JP | 2010-044875 | A | 2/2010 |
| JP | 2010-135531 | A | 6/2010 |
| JP | 4575976 | B2 | 11/2010 |
| JP | 2011-07469 | A | 1/2011 |
| JP | 2011-099567 | A | 5/2011 |
| JP | 2011-200866 | A | 10/2011 |
| WO | WO 2011/118201 | A1 | 9/2011 |

OTHER PUBLICATIONS

International Search Report (PCT/ISA/210) dated Aug. 20, 2014, by the European Patent Office as the International Searching Authority for International Application No. PCT/IB2014/058653.

Written Opinion (PCT/ISA/237) dated Aug. 20, 2014, by the European Patent Office as the International Searching Authority for International Application No. PCT/IB2014/058653.

Japanese Office Action, Notice of Grounds for Rejection, dated Sep. 16, 2014, by the Japanese Patent Office, in JP Application No. 2013-018876, and English translation of Office Action (4 pages).

Japanese Office Action, Decision of Rejection, dated Dec. 2, 2014, by the Japanese Patent Office, in JP Application No. 2013-018876, and English translation of Office Action (5 pages).

Japanese Office Action, Reconsideration Report, dated Mar. 19, 2015, by the Japanese Patent Office, in JP Application No. 2013-018876, and English translation of Office Action (4 pages).

* cited by examiner

INFRARED FURNACE AND METHOD FOR INFRARED HEATING

CROSS-REFERENCE TO RELATED APPLICATION

The present application asserts priority rights based on JP Patent Application 2013-018876 filed on Feb. 1, 2013. The entire contents of disclosure thereof are incorporated herein by reference thereto.

TECHNICAL FIELD

This invention relates to an infrared furnace and a method for infrared heating. More particularly, it relates to an infrared furnace and a method for infrared heating of a metal plate (or sheet).

BACKGROUND

With increasing needs for reducing the weight of a car body and for assuring safety against collision, a die-quenching method is attracting notice as a manufacturing method for car components. The die-quenching method is a processing method wherein quench-hardening of a heated steel plate is performed by forming and simultaneously rapidly cooling it in press metal dies.

As a method for heating a steel plate for quench-hardening, an infrared heating method is attracting notice. The infrared heating method is such a method in which infrared rays are irradiated on and absorbed by a work thereby to heat the work.

In regard to a car component, such as a car body component, there is a demand to impart variations in strength within a single component to save the labor of welding a high strength component to a low strength component to manufacture a single target component. The so manufactured single component has an advantage that a high strength may be realized by the high strength part, while the low strength part is more susceptible to processing.

The following is a brief survey of certain Patent Literatures pertinent to the above mentioned background techniques.

In Patent Literature 1, there is proposed a technique of placing a plate member of a preset shape between a steel plate and an infrared lamp and in setting a distribution of heating intensity, of at least a part of a surface side of the steel plate not covered by the plate member so as to differ from that of its surface side covered by the plate member.

In Patent Literature 2, there is proposed an infrared heater in which infrared rays of high light intensity are irradiated on a certain region of the steel plate and in which infrared rays of lower light intensity are irradiated on its other region.

In Patent Literature 3, there is proposed an infrared heater in which the number of infrared lamps lighted is selected in response to a target heating temperature of the steel plate and in which the output intensity of each of the infrared lamps lighted is set at the same value.

In Patent Literature 4, there is proposed an infrared heater in which, to exercise region-wise control of heating states of a steel plate, the output of the lamps disposed in a preset row(s) of a matrix is reduced, while that of the lamps disposed in its other row(s) is increased.

In Patent Literature 5, there is proposed an infrared heater in which press-forming of a steel plate is commenced at a condition that a portion of a steel plate is heated by infrared rays to a temperature of an Ar1 transformation point as above whereas the temperature of the remaining portion thereof is in a range between room temperature and a temperature less than the Ar1 transformation point.

PATENT LITERATURE (PTL)

Patent Literature 1: JP Patent No. 4575976
Patent Literature 2: JP Patent Kokai No. JP2011-200866A
Patent Literature 3: JP Patent Kokai No. JP2011-7469A
Patent Literature 4: JP Patent Kokai No. JP2011-99567A
Patent Literature 5: JP Patent Kokai No. JP2005-193287A

SUMMARY

The following analysis is given by the present invention. When the infrared heating is applied to a mass production process for car body components, it is desirable that reduction in temperature elevating time and energy saving are compatible (traded off) each other, and that an infrared furnace is of a simplified structure.

In a first aspect, there is provided an infrared furnace. The furnace comprises:

a plurality of infrared lamps directed to one work surface; and a reflective surface directed to an opposite work surface to reflect infrared rays.

Intensity of the infrared rays incident on the one work surface is varied depending on a position on the work.

In a second aspect, based on the first aspect, there is provided an infrared furnace, comprising:

a plurality of infrared lamps directed to one work surface and having outputs adjustable;

a reflective surface directed to an opposite work surface to reflect the infrared rays; and at least one controller that sets outputs of the infrared lamps depending on position relationship between the infrared lamps and the work.

In a third aspect based on the first aspect, there is provided an infrared furnace, comprising:

a plurality of infrared lamps directed to one work surface;

a reflective surface directed to an opposite work surface to reflect the infrared rays; and a member disposed between the plurality of infrared lamps and the one work surface to change intensity of the infrared rays depending on a position on the work.

In a fourth aspect, there is provided an infrared heating method comprising:

irradiating infrared rays so that the intensity of the infrared rays incident on one work surface will be made to vary depending on the work position; and irradiating reflected rays of the infrared rays irradiated towards the one work surface on the opposite work surface.

Advantageous Effects of the Invention are mentioned below without limitation. The above mentioned respective aspects contribute to compromising (being compatible) between reduction in temperature elevating time and energy saving as well as to applying the infrared heating to the mass production process of components such as, for instance, vehicle components.

PREFERRED MODES

Figure 1:
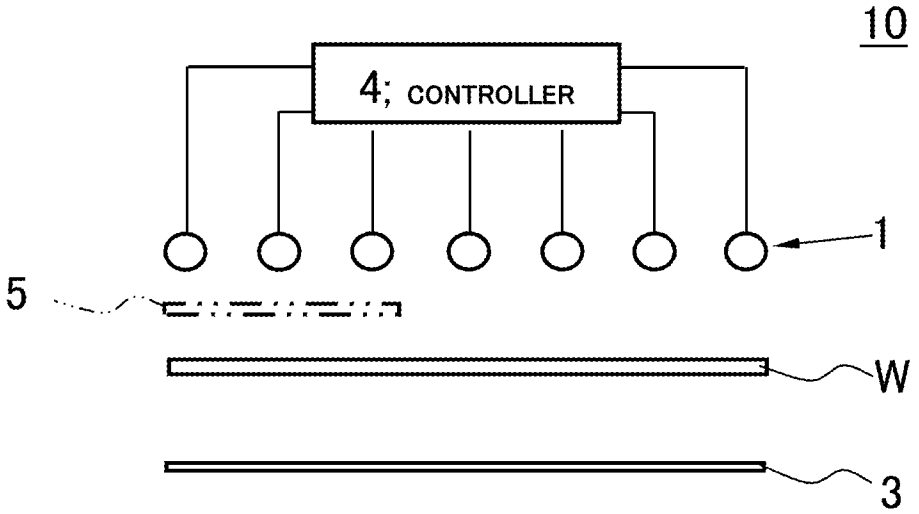
FIG. 1 is a block diagram showing a basic structure of an infrared furnace according to an exemplary embodiment.

According to exemplary embodiments of the present invention, a sufficiently short temperature elevating time and energy saving can be achieved in combination by a simplified infrared furnace structure including a plurality of infrared lamps and a reflective surface respectively provided on one and the opposite surface sides of a work. In addition, such a component exhibiting strength variations within itself may be obtained by adjustment of the local light intensity of the infrared rays incident on the one work surface. Such adjustment may be realized either by local output adjustment of the infrared lamps or by adjustment of intensity of the local infrared rays incident on the one work surface made possible by a member arranged between the infrared lamps and the one work surface. It is thus possible to reduce the size of a transitioning region, that is, a region with a gradually changing strength characteristic, inevitably formed between first and second regions at the time of (press-)forming, in one and the same component, the first and second regions differing from each other in the strength characteristics. The transitioning region exhibits a strength characteristic intermediate between the strength characteristics of the first and second regions. The reason the transitioning region is reduced in size is that the difference in temperature between the first and second regions, viz., the thermal gradient between the two regions, is decreased, and hence the heat amount flowing per unit time from the first region to the second region is decreased. There may thus be obtained a component exhibiting sharp changes in the characteristic sufficient to meet the demand for high precision in strength distribution.

The infrared heating according to the present invention may be exploited to advantage for partial heating of a steel plate (or sheet generally represented by "plate" herein) aimed to partially quench-harden the steel plate. For example, the steel plate has its first region heated, by infrared heating, to a temperature of an austenite forming temperature, while having its second region heated by the infrared heating to a temperature below (not reaching) the austenite forming temperature. The steel plate, having such a resulting temperature distribution, is supplied to a (press-) forming process, for example, a quench-hardening process. In this quench-hardening process, the first region is quenched at a cooling rate of or exceeding a critical rate and formed to generate a martensitic structure, while the second region is cooled at a rate below (not reaching) the critical rate and formed to generate a bainitic or ferritic structure. Between the first and second regions, there is inevitably formed a transitioning region exhibiting characteristics that is intermediate between the characteristics of the two regions.

Certain preferred modes of the above mentioned first aspect will now be explained in detail. With modes, set out below, the intensity of the infrared rays, incident or irradiated on the first region on one work surface, may be set by position relationships of the plurality of the infrared lamps so as to be higher than that of the infrared rays incident or irradiated on the second region. In addition, in the modes stated below, the transitioning region T can be reduced in size.

The work has a first region subjected to a preset heat treatment and a second region not subjected to the preset heat treatment. A plurality of infrared lamps are arrayed relatively densely on a site directed to the first region and one or a plurality of infrared lamps are arrayed relatively sparsely on a site directed to the second region.

The work has a first region subjected to a preset heat treatment and a second region not subjected to the preset heat treatment. On a site directed to the first region, one or a plurality of infrared lamps are arrayed relatively closely to the work, whereas, on a site directed to the second region, one or a plurality of infrared lamps are arrayed relatively remotely from the work.

Certain preferred modes in the above mentioned second aspect will now be explained. With modes, set out below, the intensity of the infrared rays, incident or irradiated on the first region on one work surface, may be set, by local adjustment of the plurality of the infrared lamps, so as to be higher than that of the infrared rays incident or irradiated on the second region. In addition, in the modes, set out below, the transitioning region T can be reduced in size.

The work has a first region subjected to a preset heat treatment and a second region not subjected to the preset heat treatment. The outputs of one or a plurality of infrared lamps, directed to the first region, among the plurality of the infrared lamps, are set, by one or a plurality of controllers, so as to be higher than those of one or more of the infrared lamps directed to the second region.

Certain preferred modes in the above mentioned third aspect will now be explained. With modes, set out below, the intensity of the infrared rays, incident or irradiated on the first region on one work surface, may be set, by the infrared rays shielding effect provided by the member, so as to be higher than that of the light incident or irradiated on the second region. In addition, in the modes, set out below, the transitioning region T can be reduced in size.

The work has a first region subjected to a preset heat treatment and a second region not subjected to the preset heat treatment, and the member is arranged intermediate between the second region and one or a plurality of infrared lamps directed to the second region.

The member may be partially transmissive to infrared rays. By the member being partially transmissive to infrared rays, the second region may be heated sufficiently, so that it is possible to prevent the temperature in the first region from being lowered due to heat conduction from the first region to the second region.

The member may also have a mesh-like shape. By a mesh-like portion of the member transmitting a fraction of the infrared rays, the second region is also sufficiently heated to prevent lowering of the temperature of the first region otherwise caused by heat conduction from the first region to the second region.

Preferably, the member may be contoured (profiled) in keeping with the contour of the first region or the second region.

The member, shielding part or all of the infrared rays, may be formed of a material selected from among ceramics, heat-resistant boards, heat-resistant iron (steel) plates and heat-resistant silica.

Preferably, the infrared lamp radiates the near infrared rays which have high energy density and which are suited to planar heating to heat a relatively narrow area. A preferred wavelength range is 0.8 to 2 micrometers. The infrared rays of a longer wavelength may also be used, if so desired.

For the infrared lamps, any suitable shape of the lamps may be used. Above all, elongated tube type lamps are desirable because of lower costs and ease with which they are fitted in the infrared furnaces. According to the present invention, sufficient variations in characteristics may be realized in a given car component with the use of the elongated tube type lamps.

The output intensity of the infrared lamp(s) may be controlled by adjusting electric power delivered or amount of current flowing through a cathode (filament) radiating the infrared rays.

The work suitable for infrared heating may be a steel plate of a variety of sorts, such as a boron steel plate, a GA steel plate and a GI steel plate, and may also be any other suitable metal plate provided that it allows for partial heat treatment.

Preferably, the reflective surface is a mirror surface or a lustrous surface which is high in infrared ray reflectance. Preferably, the reflectance is 60% or higher, 70% or higher, 80% or higher, 90% or higher. The reflective surface may be formed by, for example, diverse metal plating, such as plating of gold or silver.

It is also possible to locally cool the opposite surface of the work by one or a plurality of cooling materials. This renders it possible to cause spot-wise alterations of the work's characteristics.

Preferably, the infrared lamps are arrayed two-dimensionally or three-dimensionally depending on the contour or desired distribution characteristics of the work.

Typically, the preset heat treatment is that for quench-hardening. However, it may also be other sorts of heat treatment.

It is noted that the above modes may be combined together in desired manner as long as the advantageous effects of the present invention may thereby be maintained.

Referring to the drawings, certain exemplary embodiments of the present invention will be described with reference to the drawings. It is noted that symbols for reference to the drawings are appended for convenience sake to respective elements in the drawings and are not intended to restrict the invention to the modes illustrated.

Basic Structure of an Infrared Furnace

Referring to FIG. 1, a basic structure of an infrared furnace 10 according to an exemplary embodiment of the present invention will be explained. The infrared furnace 10 includes a plurality of infrared lamps 1 directed to one surface of a work W, a reflective surface 3 directed to the opposite surface of the work W to reflect the infrared rays, and a controller 4 capable of individually setting an output of each of the infrared lamps 1. The controller 4 exercises on/off control and output control of a plurality of infrared lamps 1.

In the infrared furnace 10, the intensity of the infrared rays incident on the one surface of the work W can be made to vary depending on the position on (or within) the work W.

Such partial adjustment of the incident light intensity on the one surface of the work W may be accomplished by exploiting local output adjustment of a plurality of the infrared lamps 1, the output of which is freely adjustable, a member 5 shielding the infrared rays, or both.

A plurality of the controllers 4 may be provided in a one-to-one correspondence to the infrared lamps 1, the outputs of which may then be adjusted individually. In case the work W is supported from below by a plurality of pins, the infrared lamps 1 are preferably arranged on an upper side, as shown in FIG. 1. In case the work W is suspended from above, a plurality of the infrared lamps 1 are preferably arranged on a lower side. One or more of the controller(s) 4 are used in a number of ways for output adjustment of a plurality of the infrared lamps 1 in diverse exemplary embodiments which will be mentioned subsequently.

Certain advantageous effects, derived from provision of the reflective surface 3, will now be explained with reference to the results of the following experiment 1.

Experiment 1

A temperature elevating speed of a boron steel plate, 1.6 mm in thickness, was measured for single side heating and double side heating. In the single side heating, a plurality of the infrared lamps 1 were provided only on a single side of the work W, and a reflective surface 3 was provided on its opposite side, as shown in FIG. 1. In the double side heating, a plurality of infrared lamps 1 were provided on a single side of the work W, while another plurality of infrared lamps 1 were provided on its opposite side. At the same time, the temperature difference between the temperature on the single side of the work W (a boron steel plate) and that on its opposite side was measured. It is noted that, since the number of the infrared lamps 1 required to provide for the double side heating is twice as many as that for the single side heating, the electric power required for the double side heating is double that for the single side heating.

Figure 2:
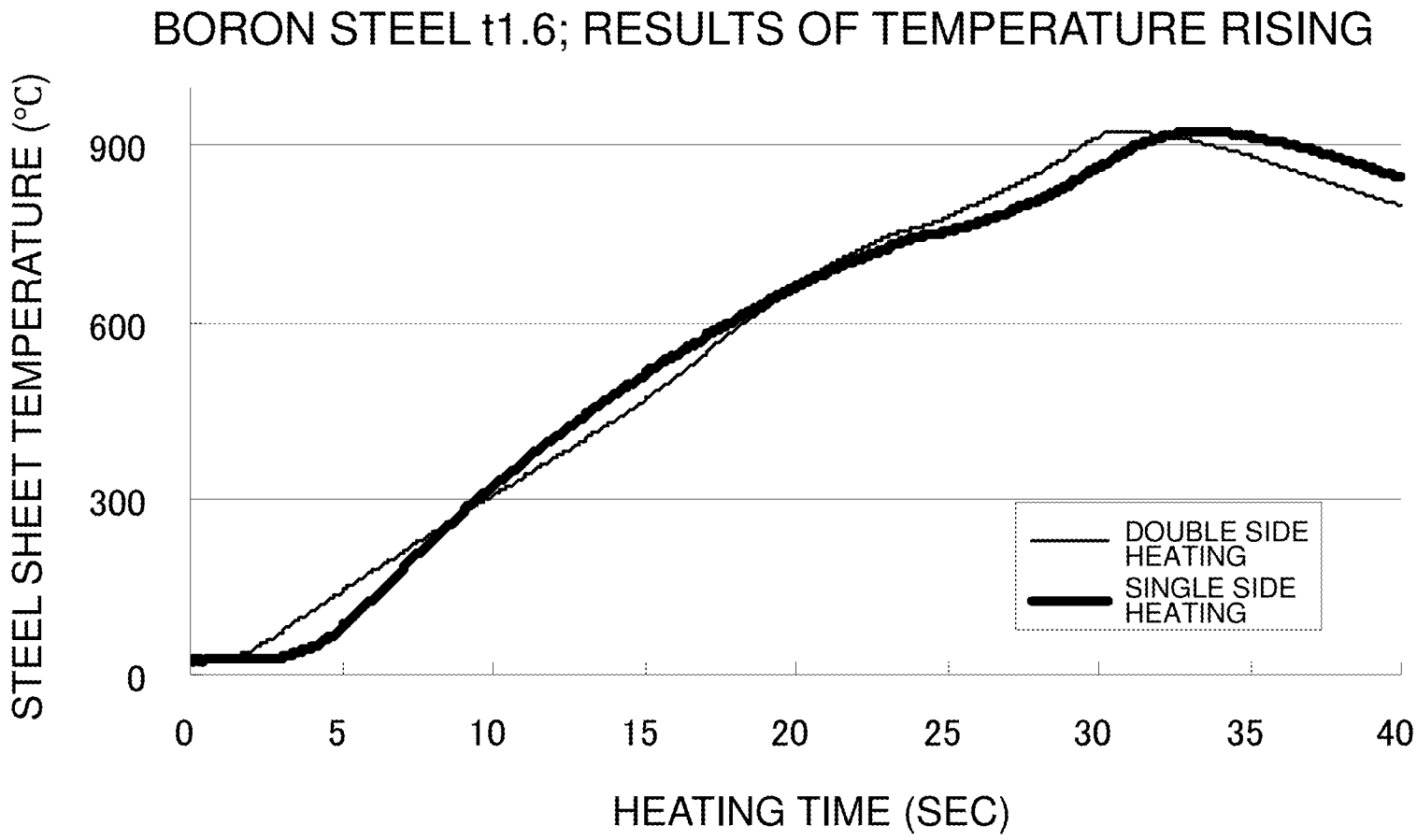
FIG. 2 is a graph showing results of experiment 1.

FIG. 2 depicts a graph showing the temperature elevating speed of the boron steel plate in the case of the single side heating and that in the case of the double side heating. It is seen from FIG. 2 that the time that elapses since the temperature is raised from room temperature to reach 900 degrees Celsius for the case of the single side heating and that for the case of double heating are 31.4 sec and 29.6 sec, respectively, indicating that there is no significant difference between the two. It may thus be seen that sufficiently short steel plate temperature elevating time may be obtained by the single side heating as power saving is achieved. It is noted that, even in the case of the single side heating, a temperature difference between the one and the opposite sides of the steel plate is suppressed to not greater than 5 degrees Celsius, such temperature difference being at a level not problematical in regard of temperature control.

Exemplary Embodiment 1

Figure 3A:
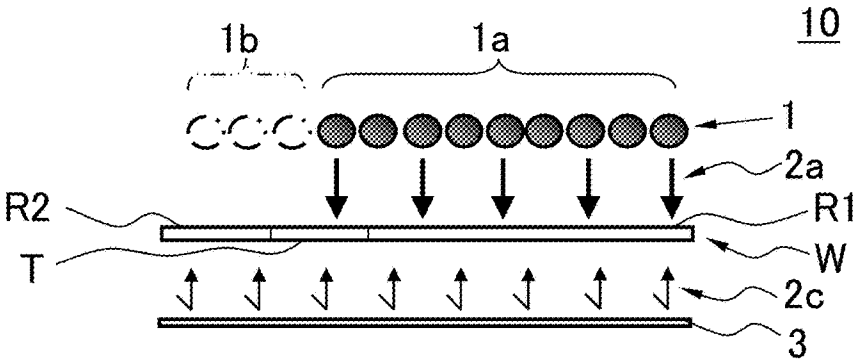
FIG. 3(A) is a schematic view showing a structure of an infrared furnace according to exemplary embodiment 1 and FIG. 3(B), FIG. 3(C) are schematic views showing distribution of characteristics of a work heated by the infrared furnace.
Figure 3B:
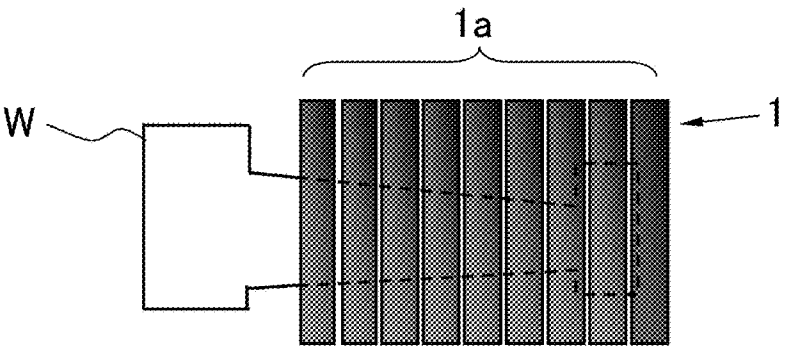

FIG. 3(A) depicts a front view schematically showing an internal structure of an infrared furnace according to exemplary embodiment 1. FIG. 3(B) depicts a plan view showing the infrared lamps and the work of FIG. 3(A), and FIG. 3(C) a plan view showing a distribution of characteristics of the work heated by the infrared furnace of FIG. 3(A).

Referring to FIG. 3(A) and FIG. 3(B), an infrared furnace 10 of exemplary embodiment 1 includes a plurality of infrared lamps 1 directed to one surface of a work W, and a reflective surface 3 directed to the opposite surface of the work W to reflect the infrared rays. The output values of the infrared lamps are adjustable.

Out of the plurality of the infrared lamps 1, infrared lamps 1*a*, directed to a first region R1 of the work W, are turned on to radiate infrared rays 2*a* at an output value as set by the controller 4 shown in FIG. 1, while infrared lamps 1*b*, directed to a second region R2 of the work W, are turned off. Thus, the infrared rays 2*a* are selectively incident or irradiated on the first region R1. Note that the infrared lamps 1*b* may be dismounted at this time.

On the opposite surface side of the work W, a portion of the infrared rays 2*a* is reflected from the reflective surface 3 to generate reflected rays 2*c* which then are incident on the opposite surface of the work W.

Figure 3C:
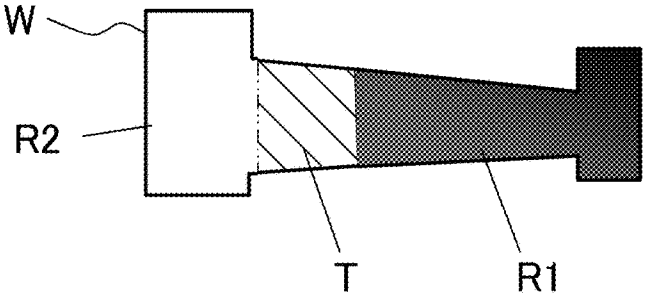

Referring to FIG. 3(C), the first region R1 and the second region R2 having a temperature difference that will allow for imparting difference in characteristics, such as strength, are formed in the work W by the above mentioned infrared heating. For example, the first region R1 is heated to a temperature of or above a temperature necessary for quench-hardening and is then cooled rapidly to produce high strength and high hardness. The second region R2 is heated to a temperature below (not reaching) the quench-hardening temperature and is then cooled to produce low strength and low hardness. Note that a transitioning region T is inevitably formed between the first region R1 and the second region R2. The transitioning region T exhibits characteristics intermediate between the characteristics of the first region R1 and those of the second region R2.

Exemplary Embodiment 2

Figure 4A:
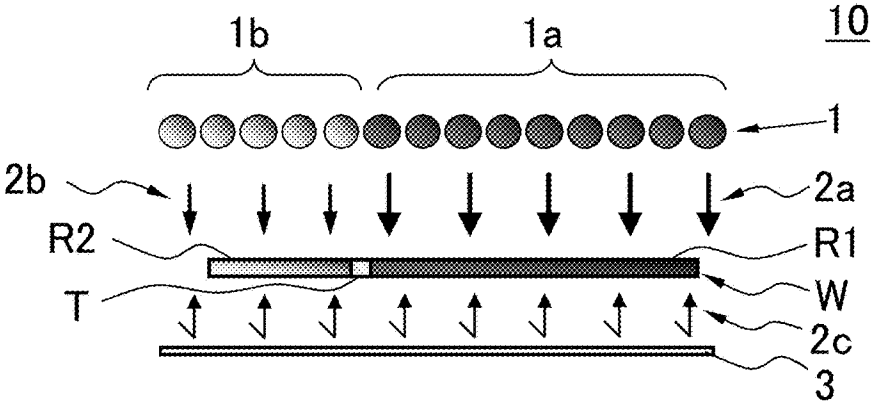
FIG. 4(A) is a schematic view showing a structure of an infrared furnace according to exemplary embodiment 2 and FIG. 4(B), FIG. 4(C) are schematic views showing distribution of characteristics of a work heated by the infrared furnace.
Figure 4B:
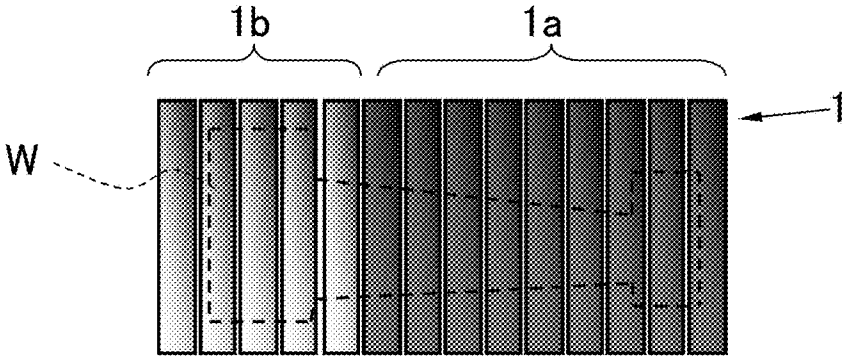

FIG. 4(A) depicts a schematic front view showing an internal structure of an infrared furnace according to exemplary embodiment 2. FIG. 4(B) depicts a plan view showing a plurality of infrared lamps and a work, and FIG. 4(C) depicts a plan view showing the distribution of characteristics of the work heated by the infrared furnace of FIG. 4(A).

Referring to FIG. 4(A), exemplary embodiment 2 features setting the output values of a plurality of infrared lamps 1, by the controller 4 shown in FIG. 1, depending on the position relationships between the infrared lamps 1 and the work W. In the explanation of exemplary embodiment 2 to follow, mainly the points of difference of the subject exemplary embodiment 2 from the above described exemplary embodiment 1 are explained. Reference may be made as necessary to the explanation of exemplary embodiment 1 as regards the matter common to subject exemplary embodiment 2 and exemplary embodiment 1.

Referring to FIG. 4(A) and FIG. 4(B), showing the infrared furnace 10 of exemplary embodiment 2, those infrared lamps 1*a* directed to the first region R1 of the work W, out of the plurality of the infrared lamps 1, radiate infrared rays 2*a* of higher light intensity. On the other hand, the infrared lamps 1*b*, directed to the second region R2 of the work W, radiate infrared rays 2*b* of lower light intensity. Hence, the infrared rays 2*a* of higher light intensity are incident on the first region R1 of the one surface, while the infrared rays 2*b* of lower light intensity are incident on its second region R2, at the same time as reflected rays 2*c* from the reflective surface 3 are incident on the opposite (other) surface of the work W.

Figure 4C:
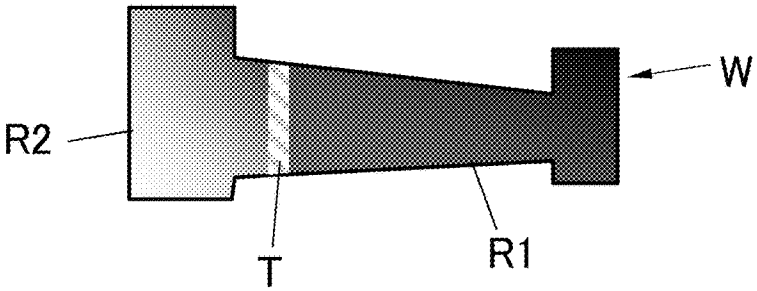

Referring to FIG. 4(C), a transitioning region T narrower in width than that of exemplary embodiment 1 is formed between the first region R1 and the second region R2 as a result of the infrared heating of exemplary embodiment 2. The reason is that, in exemplary embodiment 2, the infrared lamps 1*b*, directed to the second region R2, are also turned on, and hence the temperature difference between the first region R1 and the second region R2 is reduced. The heat flux from the first region R1 to the second region R2 per unit time is thus decreased to suppress that the temperature of the portion of the first region R1 neighbored to the second region R2 falls to a temperature being below the quench-hardening temperature.

Exemplary Embodiment 3

Figures 5A, 5B, 5C:
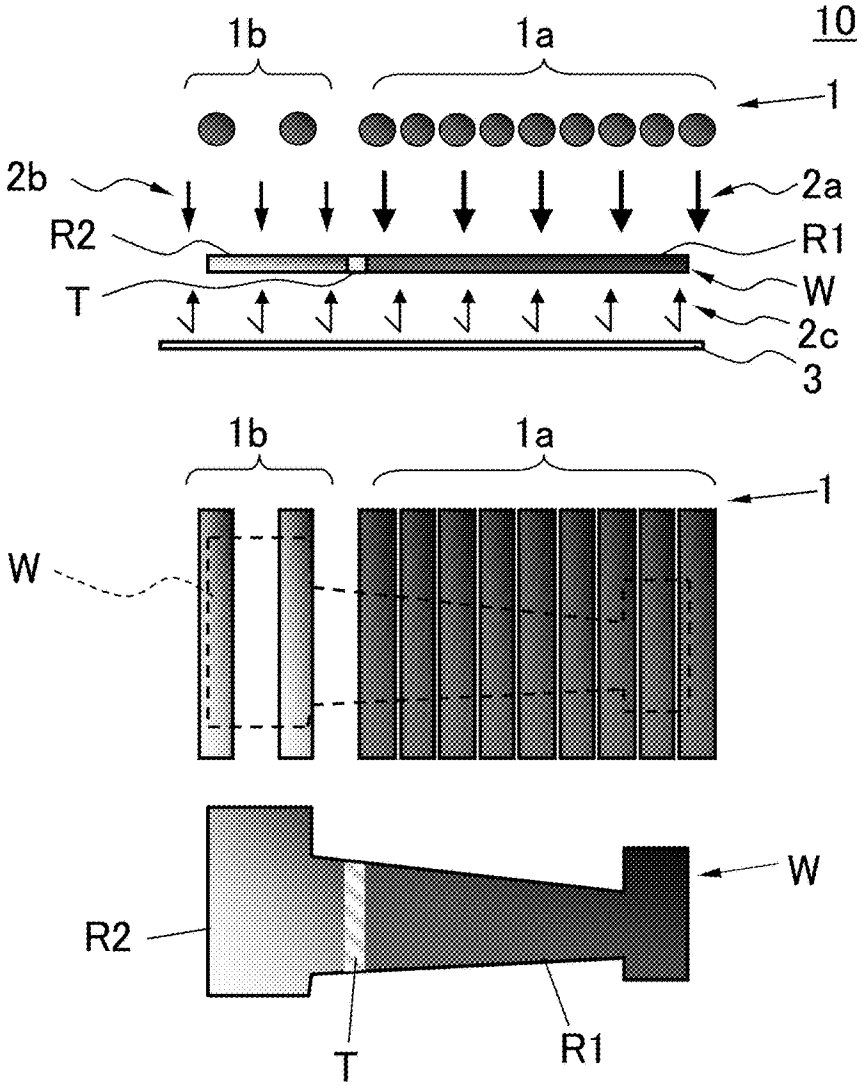
FIG. 5(A) is a schematic view showing a structure of an infrared furnace according to exemplary embodiment 3 and FIG. 5(B), FIG. 5(C) are schematic views showing distribution of characteristics of a work heated by the infrared furnace.

FIG. 5(A) depicts a schematic front view showing an internal structure of an infrared furnace according to exemplary embodiment 3. FIG. 5(B) depicts a plan view showing a plurality of infrared lamps and a work of FIG. 5(A), and FIG. 5(C) depicts a plan view showing the distribution of characteristics of the work heated by the infrared furnace of FIG. 5(A).

Referring to FIG. 5(A), exemplary embodiment 3 features varying the intensity of the infrared rays, incident on one surface of the work W, depending on the position on the work W, by relying upon the arraying density of the infrared lamps 1. In the explanation of exemplary embodiment 3 to follow, mainly the points of difference of the subject exemplary embodiment 3 from the above described exemplary embodiment 2 are explained. As for the matters common to the two exemplary embodiments, reference is to be made as necessary to explanation of exemplary embodiment 2.

Referring to FIGS. 5(A) and 5(B), in the infrared furnace 10 of the subject exemplary embodiment 3, a plurality of infrared lamps 1*a* are arrayed relatively densely at positions directed to the first region R1, while one or a plurality of infrared lamps 1*b* are arrayed relatively sparsely at positions directed to the second region R2. Thus, even though the infrared lamps 1*a*, 1*b* radiate infrared rays with the same light intensity, infrared rays 2*a* of high light intensity impinge on one surface of the first region R1, while infrared rays 2*b* of low light intensity impinge on one surface of the second region R2, at the same time as reflected rays 2*c* from the reflective surface 3 impinge on the opposite surface of the work W.

Referring to FIG. 5(C), a transitioning region T narrower in width than that of exemplary embodiment 1 is formed between the first region R1 and the second region R2 as a result of the infrared heating of exemplary embodiment 3. The reason is that, in exemplary embodiment 3, the one or the plurality of the infrared lamps 1*b*, directed to the second region R2, are also lighted (on).

Exemplary Embodiment 4

Figures 6A, 6B, 6C:
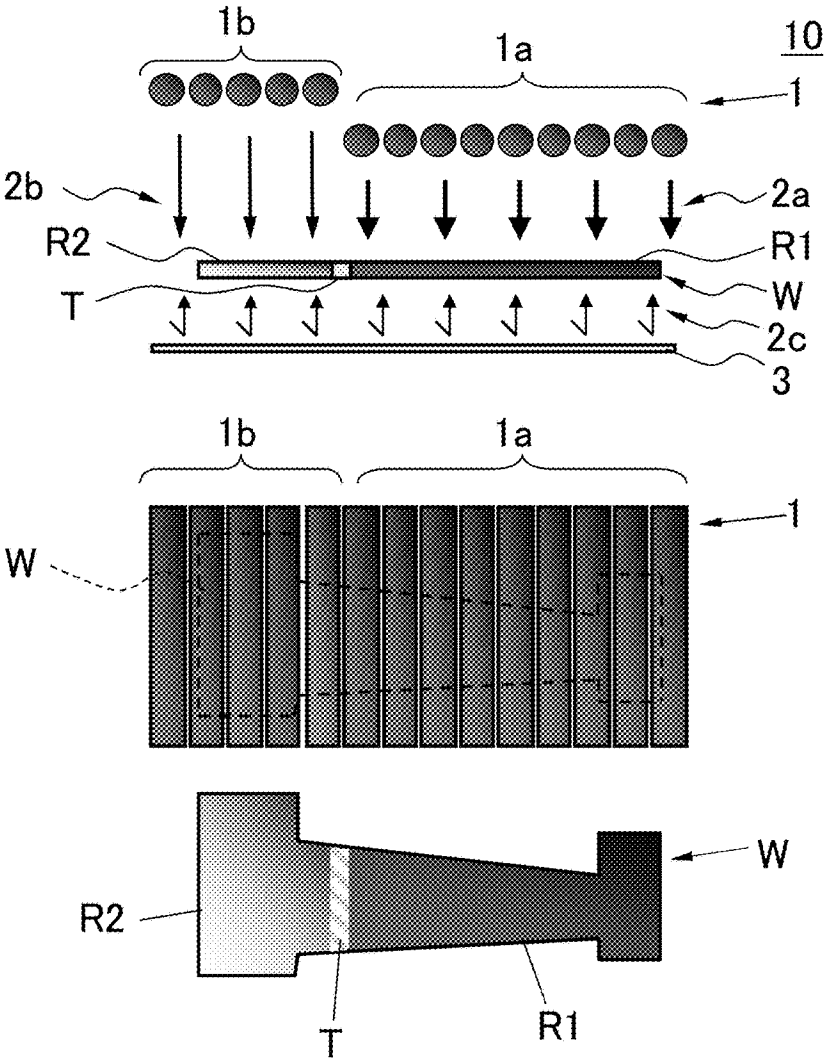
FIG. 6(A) is a schematic view showing a structure of an infrared furnace according to exemplary embodiment 4 and FIG. 6(B), FIG. 6(C) are schematic views showing distribution of characteristics of a work heated by the infrared furnace.

FIG. 6(A) depicts a schematic front view showing an internal structure of an infrared furnace according to exemplary embodiment 4. FIG. 6(B) depicts a plan view showing a plurality of infrared lamps and a work of FIG. 6(A), and FIG. 6(C) depicts a plan view showing the distribution of characteristics of the work heated by the infrared furnace of FIG. 6(A).

Referring to FIG. 6(A), exemplary embodiment 4 features varying the intensity of the infrared rays, incident on one surface of the work W, depending on the position on the work W, by relying upon the distance between the infrared lamps 1 and the work W. In the explanation of exemplary embodiment 4 to follow, mainly the points of difference of the subject exemplary embodiment 4 from the above described exemplary embodiment 2 are explained. As for the matters common to the two exemplary embodiments, reference is to be made as necessary to the explanation of exemplary embodiment 2.

Referring to FIGS. 6(A) and 6(B), in the infrared furnace 10 of the subject exemplary embodiment 4, a plurality of infrared lamps 1*a* are arrayed relatively closely to the work W at sites directed to the first region R1, while a plurality of infrared lamps 1*b* are arrayed relatively remotely from the work W at sites directed to the second region R2. Thus, even though the infrared lamps 1*a*, 1*b* radiate infrared rays with the same light intensity, infrared rays 2*a* of high light intensity impinge on one surface of the first region R1, while infrared rays 2*b* of low light intensity impinge on the one surface of the second region R2, at the same time as reflected rays 2*c* from the reflective surface 3 impinge on the opposite surface of the work W.

Referring to FIG. 6(C), a transitioning region T narrower in width than that of exemplary embodiment 1 is formed between the first region R1 and the second region R2 as a result of the infrared heating of exemplary embodiment 4. The reason is that, in exemplary embodiment 4, one or more of the infrared lamps 1*b*, directed to the second region R2, are also lighted (on).

Exemplary embodiment in which the intensity of infrared rays incident on the work is varied, depending on the position on the work, by relying upon the infrared rays screening effect by a member, and so forth, will now be explained.

Exemplary Embodiment 5

Figures 7A, 7B, 7C:
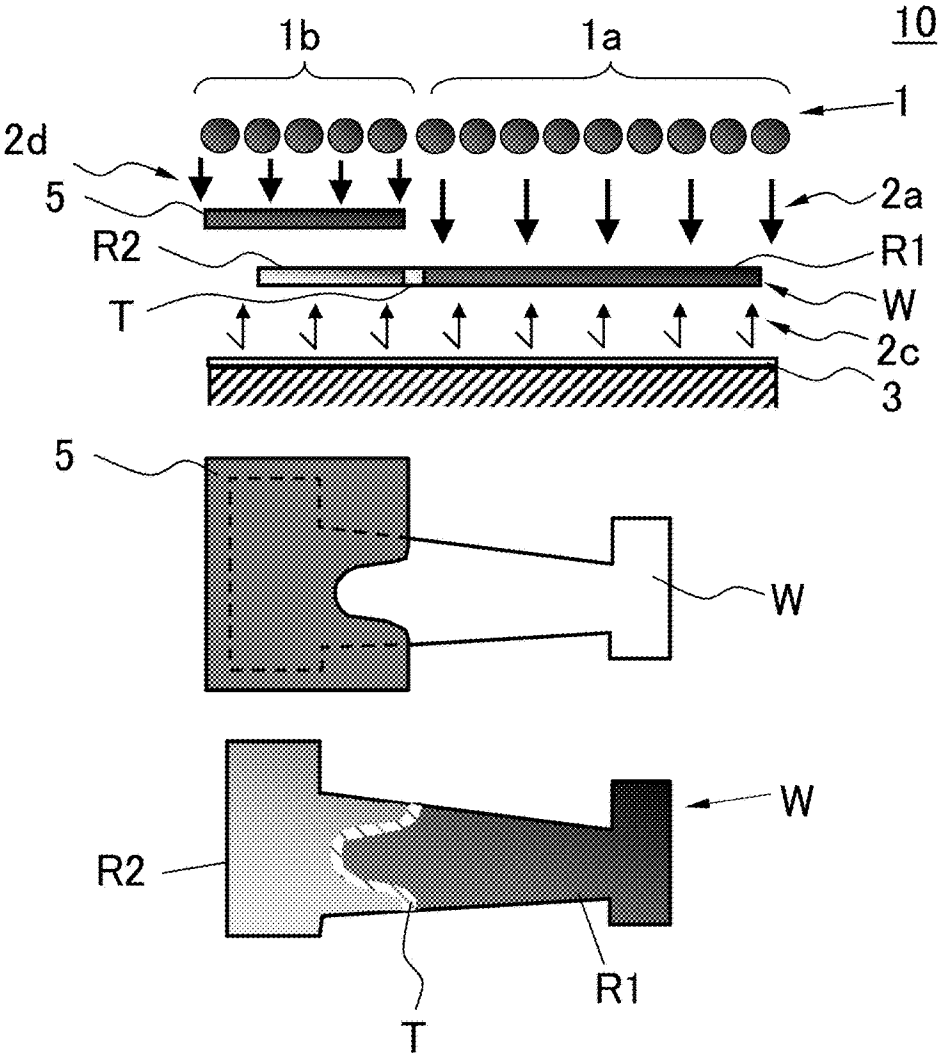
FIG. 7(A) is a schematic view showing a structure of an infrared furnace according to exemplary embodiment 5 and FIG. 7(B), FIG. 7(C) are schematic views showing distribution of characteristics of a work heated by the infrared furnace.

FIG. 7(A) depicts a schematic front view showing an internal structure of an infrared furnace according to exemplary embodiment 5. FIG. 7(B) depicts a plan view showing a plurality of infrared lamps and a work of FIG. 7(A), and FIG. 7(C) depicts a plan view showing the distribution of characteristics of the work heated by the infrared furnace of FIG. 7(A).

Referring to FIG. 7(A) and FIG. 7(B), an infrared furnace 10 of the subject exemplary embodiment 5 includes a plurality of infrared lamps 1 directed to one surface of a work W and having adjustable output values, and a reflective surface 3 directed to the opposite surface of the work W to reflect infrared rays. The infrared furnace 10 also includes a plate-shaped member 5 disposed between the plurality of infrared lamps 1 and the one surface of the work W to vary the intensity of the infrared rays impinging on the work W depending on the position on the work W. The member 5 is placed between the second region R2 of the work W and a number of infrared lamps 1*b* directed to the second region. The member 5 has a curved contour in keeping with contour(s) desired of the first and second regions R1, R2.

When the infrared lamps 1 are turned on, the infrared lamps 1, made up of infrared lamps 1*a*, 1*b*, radiate infrared rays at the same intensity. The infrared rays 2*a* from the infrared lamps 1*a*, directed to the first region R1 of the work W, directly impinge on the first region R1. On the other hand, the infrared rays 2*d*, radiated from the infrared lamps 1*b*, directed to the second region R2 of the work W via the member 5, are shielded by the member 5. Thus, even though the infrared lamps 1*a*, 1*b* radiate infrared rays at the same light intensity, the intensity of the infrared rays irradiating the first region R1 is greater than that of the infrared rays impinging on the second region R2.

On the opposite surface side of the work W, part of the infrared rays 2*a* are reflected by the reflective surface 3 to form the reflected rays 2*c* which then impinge on the opposite surface of the work W. This prevents the temperature of the second region R2, directed to the member 5, from becoming too low. It is also possible to control the temperature of the second region R2, based on the infrared ray reflectance of the reflective surface 3, such as to vary the width of the transitioning region T, which will now be discussed.

Referring to FIG. 7(C), the first region R1 and the second region R2, exhibiting a temperature differential such as to impart the difference in characteristics, such as strength, to the work W, by the above mentioned infrared heating, are formed in the work. For example, the first region R1 is heated to a temperature of or above that necessary for quench-hardening and then rapidly cooled to high strength and high hardness. The second region R2 is heated to a temperature below the quench-hardening temperature and then cooled to low strength and low hardness. Note that the transitioning region T is inevitably formed between the first region R1 and the second region R2. The transitioning region T has characteristics that are intermediate between the first region R1 and the second region R2. Since the infrared lamps 1*b*, directed to the second region R2, are also turned on, and the reflected rays 2*c* from the reflective surface 3 provides for additional heating of the opposite surface of the work W, the transitioning region T generated between the first region R1 and the second region R2 becomes narrower than in exemplary embodiment 1. It is noted that partial shielding of the infrared rays by the member of exemplary embodiment 5 may be used in conjunction with output adjustment of the infrared lamps of exemplary embodiment 2 described above.

The shielding effect by the member 5 will now be verified as the results of experiment 2, which will now be elucidated, are referred to.

Experiment 2

In an infrared furnace 10, shown in FIG. 7(A), a steel plate (work W) was heated by infrared rays and cooled rapidly or not rapidly, using the member 5 shielding the infrared rays, so that the steel plate will be quenched (quench-hardened) partially. Measurements were then made of the Vickers Hardness distribution along the lengthwise direction of the steel plate, i.e., in the left-right direction in FIG. 7(C). Note that the Vickers hardness of the steel plate is proportional to its strength. The work W used was a boron steel plate 500 mm long, 300 mm wide and 1.6 mm thick. As the member 5, a first plate member 50 mm wide and a second plate member 100 mm wide were used. These plate members were placed between the boron steel plate and the infrared lamps 1. In the lengthwise direction of the steel plate, the first plate member was placed so that its center was at 100 mm as measured from a longitudinal end of the boron steel plate, while the second plate member was placed so that its center was at 400 mm as measured from the longitudinal end of the boron steel plate. Also, for comparison sake, the above mentioned boron steel plate was infrared heated and subsequently cooled, after which the Vickers hardness distribution was measured in the similar manner to the above, without use of the first and second plate members.

Figure 8:
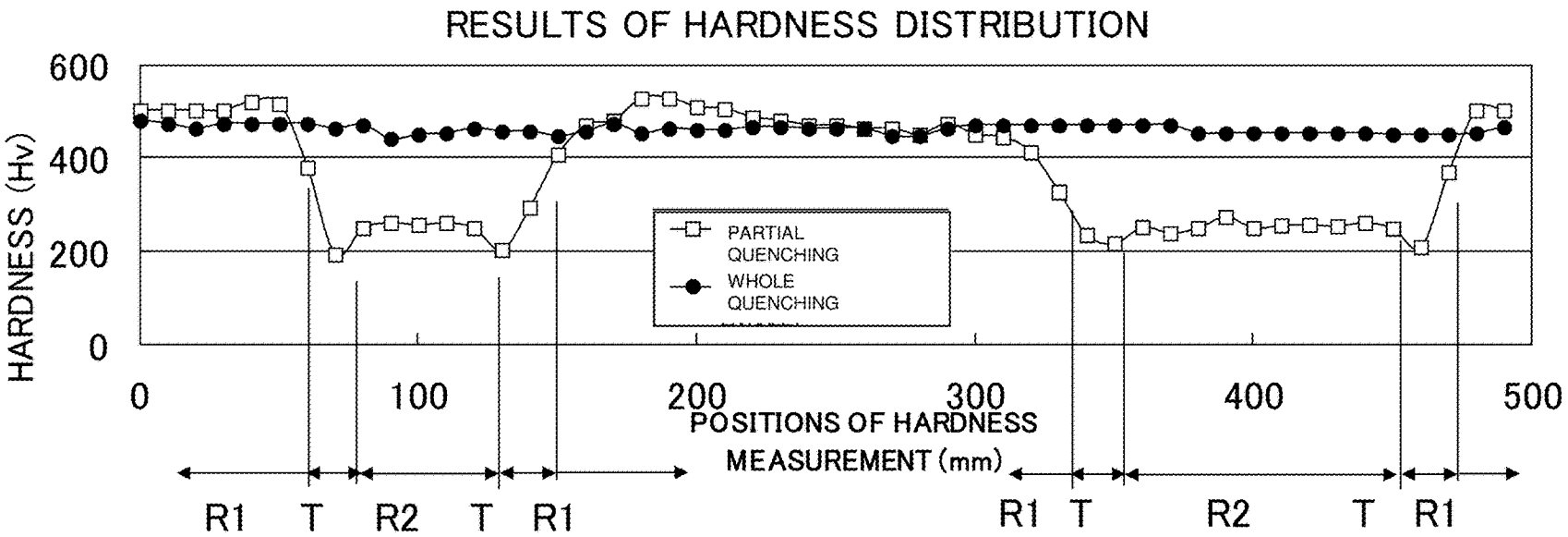
FIG. 8 is a graph showing results of experiment 2.

FIG. 8 depicts a graph showing the results of experiment 2. Hollow square-shaped plots represent the hardness distribution along the lengthwise direction in case infrared heating was carried out using the first and second plate members. On the other hand, black solid circular plots represent the hardness distribution along the lengthwise direction in case infrared heating was carried out without using these plate members.

In scrutinizing the Vickers hardness distribution shown in FIG. 8, it is seen that a second region R2, 50 mm in width, was formed beneath the first plate member of 50 mm in width, and that a transitioning region T, 20 mm in width, was formed on each side of the second region R2. It is also seen that another second region R2 100 mm in width was formed beneath the second plate member of 100 mm in width, and that another transitioning region T, 20 mm in width, was formed on each side of the second region R2, with the remaining portions of the work being the first region R1.

From the above, it has been confirmed that, by partially shielding the infrared rays by the member 5, such a component that exhibits strength variations within itself can be produced. Also, scarcely any changes in the temperature difference were observed between the one and opposite side surfaces of the work W, even in a region directly beneath the member 5, as in experiment 1. This result is thought to be ascribable to placement of the reflective surface 3 on the opposite surface side of the work W. It may also be surmised that the width of the transitioning region T has been reduced under the effect of the reflective surface 3, or the like.

Exemplary Embodiment 6

Figures 9A, 9B, 9C:
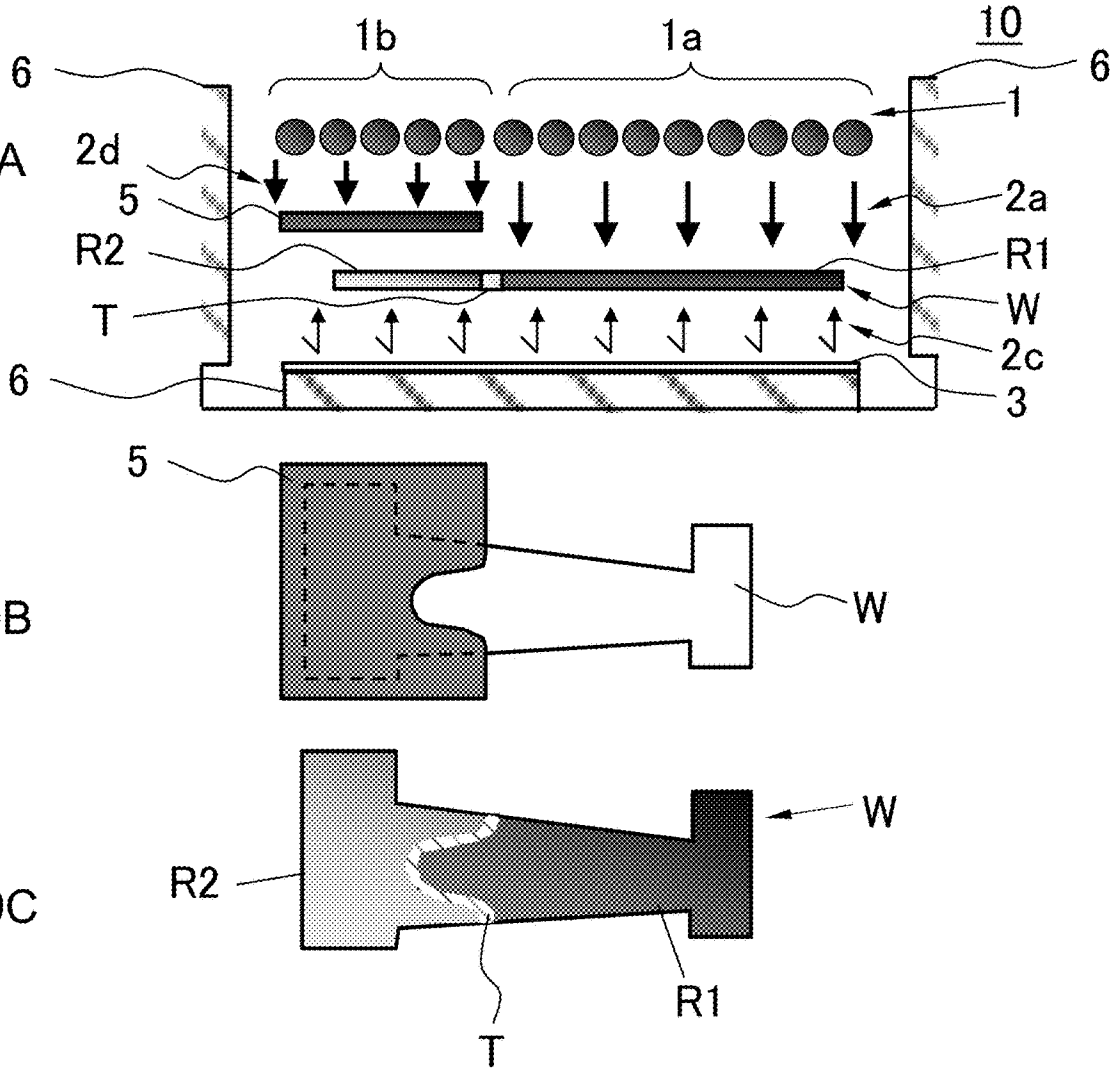
FIG. 9(A) is a schematic view showing the structure of an infrared furnace according to exemplary embodiment 6 and FIG. 9(B), FIG. 9(C) are schematic views showing the distribution of characteristics of a work heated by the infrared furnace.

FIG. 9(A) depicts a schematic front view showing an internal structure of an infrared furnace according to exemplary embodiment 6. FIG. 9(B) depicts a plan view showing a plurality of infrared lamps and a work of FIG. 9(A), and FIG. 9(C) depicts a plan view showing the distribution of characteristics of the work heated by the infrared furnace of FIG. 9(A).

Referring to FIG. 9(A), exemplary embodiment 6 features arranging one or a plurality of heat storage material(s) 6 around or partially around the work W at a place opposing the work W. In the explanation of exemplary embodiment 6 to follow, mainly the points of difference of the subject exemplary embodiment 6 from the above described exemplary embodiment 5 are explained. As for the matters common to the two exemplary embodiments, reference is to be made as necessary to the explanation of exemplary embodiment 5.

Still referring to FIG. 9(A), in the infrared furnace 10 of exemplary embodiment 6, a plurality of infrared lamps 1 are disposed on top of the work W, and the heat storage materials 6 are disposed on the remaining three sides of the work.

The heat storage material(s) 6 radiates heat stored therein to assist in heating the second region R2 to, e.g., a temperature below the quench-hardening temperature. For the heat storage materials 6, which may also be used in the other exemplary embodiments, ceramic heat resistant boards, as an example, or the like.

Exemplary Embodiment 7

Figures 10A, 10B, 10C:
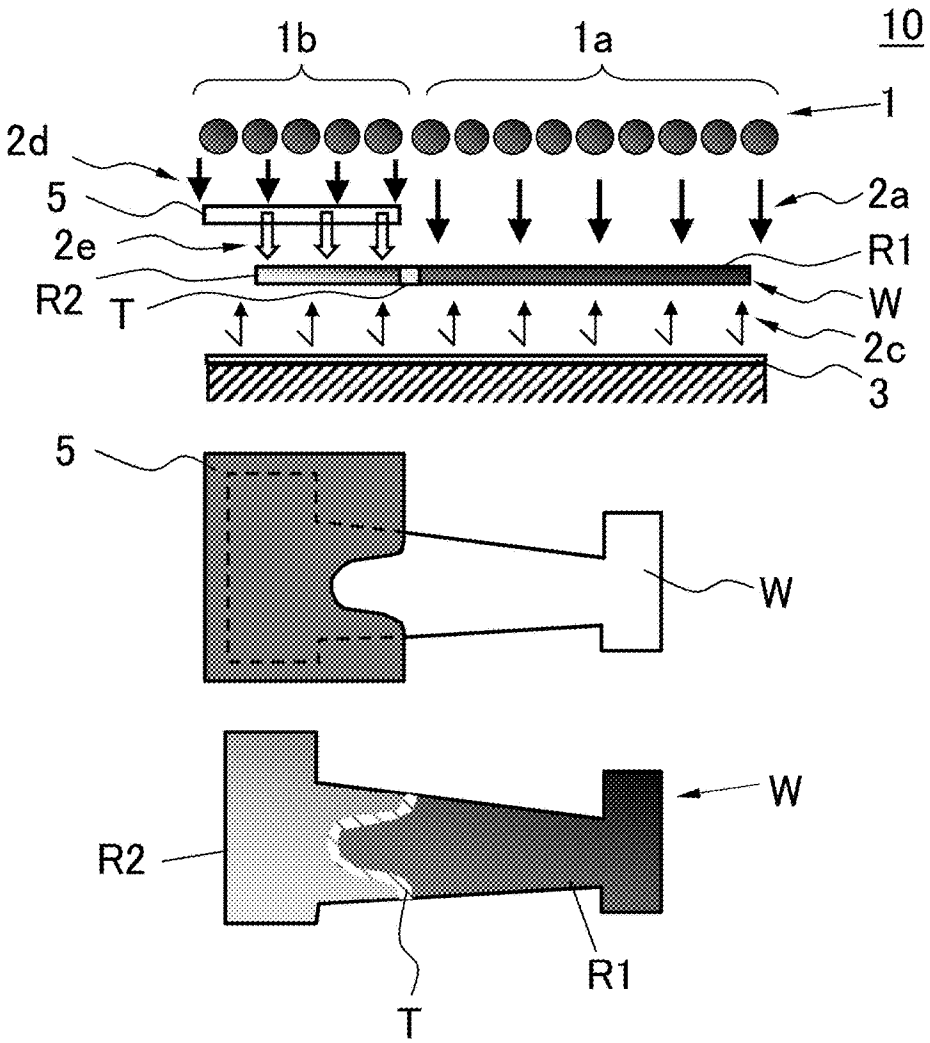
FIG. 10(A) is a schematic view showing a structure of an infrared furnace according to exemplary embodiment 7 and FIG. 10(B), FIG. 10(C) are schematic views showing distribution of characteristics of a work heated by the infrared furnace.

FIG. 10(A) depicts a schematic front view showing an internal structure of an infrared furnace according to exemplary embodiment 7. FIG. 10(B) depicts a plan view showing a plurality of infrared lamps and a work W, shown in FIG. 10(A), and FIG. 10(C) depicts a plan view showing the distribution of characteristics of the work heated by the infrared furnace of FIG. 10(A).

Referring to FIG. 10(A), exemplary embodiment 7 features using, as the member 5, a plate exhibiting the property to partially transmit the infrared rays therethrough. In the explanation of exemplary embodiment 7 to follow, mainly the points of difference of the subject exemplary embodiment 7 from the above described exemplary embodiment 5 are explained. As for the matters common to the two exemplary embodiments, reference is to be made as necessary to the explanation of exemplary embodiment 5.

Referring to FIG. 10(A) and FIG. 10(B), in the infrared furnace 10 of exemplary embodiment 7, part of the infrared rays 2*d*, radiated from a plurality of infrared lamps 1*b*, directed to the member 5 that exhibits the property of partial light transmission for the infrared rays, can be transmitted through the member 5 to form transmitted rays 2*e*. Hence, the transmitted rays 2*e* can impinge on one surface of the second region R2 of the work W. Thus, even if the plurality of the infrared lamps 1*a*, 1*b* are radiated with the same light intensity, the intensity of the infrared rays 2*a*, incident on the first region R1, is higher than that of the infrared rays incident on the second region R2, that is, the intensity of the transmitted rays 2*e*. However, since the second region R2 is also sufficiently heated by the reflected rays 2*c* and the transmitted rays 2*e*, the transitioning region T is of a narrower width. Note that the member 5, exhibiting the property of partial light transmission for the infrared rays, may be formed of stained quartz glass or semi-transparent ceramics exhibiting a desired rate of light transmission.

Exemplary Embodiment 8

Figure 11D:
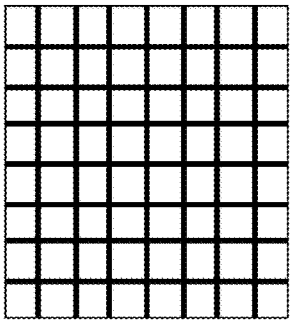
FIG. 11(D) is a schematic view showing a mesh-like part of a member shielding the infrared rays and FIG. 11(E) is a schematic view showing a modification of the mesh-like part.
Figure 11E:
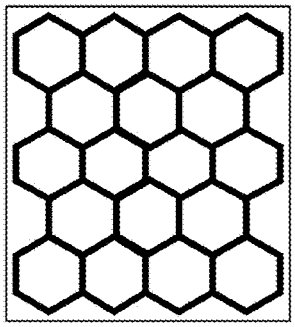
Figure 11A:
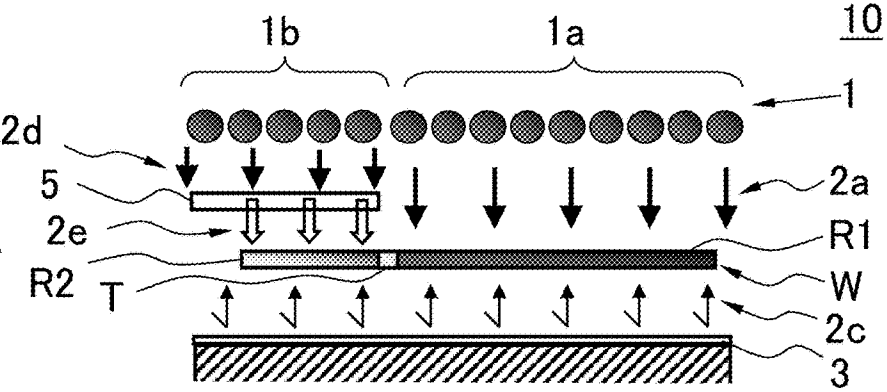
FIG. 11(A) is a schematic view showing a structure of an infrared furnace according to exemplary embodiment 8.
Figure 11B:
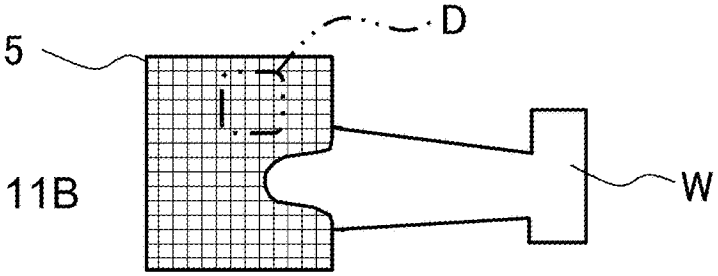
FIG. 11(B), FIG. 11(C) are schematic views showing distribution of characteristics of a work heated by the infrared furnace.
Figure 11C:
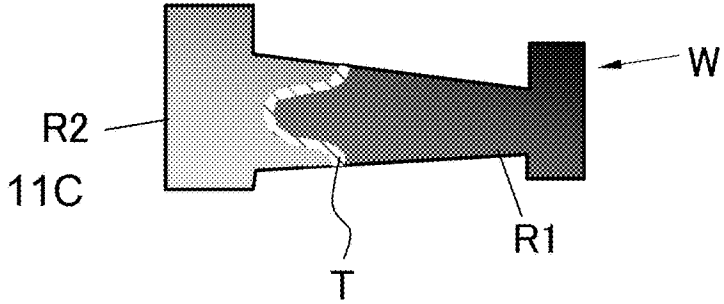

FIG. 11(A) depicts a schematic front view showing an inner structure of an infrared furnace according to exemplary embodiment 8. FIG. 11(B) is a plan view showing a plurality of infrared lamps and a work of FIG. 11(A), and FIG. 11(C) is a plan view showing the distribution of characteristics of the work heated by the infrared furnace of FIG. 11(A). FIG. 11(D) depicts a partially enlarged view of the member shown in FIG. 11(B), and FIG. 11(E) a plan view showing a modification of the member shown in FIG. 11(D).

Referring to FIG. 11(B), exemplary embodiment 8 features using a mesh-like plate as the member 5. In the explanation of exemplary embodiment 8 to follow, mainly the points of difference of the subject exemplary embodiment 8 from the above described exemplary embodiment 7 are explained. Reference may be made as necessary to the explanation of exemplary embodiment 7 as for matters common to the two exemplary embodiments.

Referring to FIG. 11(A) and FIG. 11(B), in the infrared furnace 10 of exemplary embodiment 8, since the member 5 has a mesh-like shape, part of the infrared rays 2*d*, radiated from a plurality of the infrared lamps 1*b* directed thereto is transmitted through the member 5 to impinge on one surface of the second region R2 of the work W. Thus, even if the plurality of the infrared lamps 1*a*, 1*b* are radiated at the same light intensity, the intensity of the infrared rays 2*a*, incident on the first region R1, is higher than that of the transmitted rays 2*e* incident on the second region R2. However, since the second region R2 is also sufficiently heated by the reflected rays 2*c* and the transmitted rays 2*e*, the transitioning region T is of a narrower width.

The mesh may be in the form of a lattice (or grid), as shown in FIG. 11(D), or may be honeycomb- or hexagonally-shaped, such as to increase the mechanical strength, as shown in FIG. 11(E). The member 5 may be formed of ceramics having a mesh-like shape or of porous ceramics.

Exemplary Embodiment 9

Figure 12A:
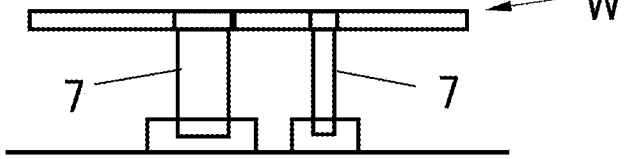
FIG. 12(A) is a schematic view showing a structure of an infrared furnace according to exemplary embodiment 9 and FIG. 12(B) is a schematic view showing distribution of characteristics of a work heated by the infrared furnace.
Figure 12B:
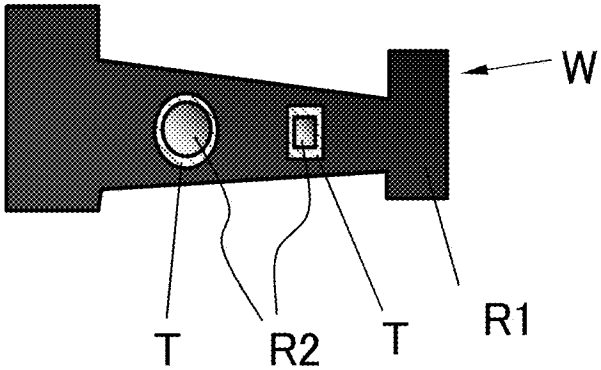

FIG. 12(A) depicts a front view partially showing an internal structure of an infrared furnace according to exemplary embodiment 9 and FIG. 12(B) a plan view showing the distribution of characteristics of a work heated by the infrared furnace of FIG. 12(A).

Referring to FIG. 12(A), the infrared furnace of exemplary embodiment 9 includes cooling materials (bodies) 7, 7 that locally cool the opposite surface of the work W. Referring to FIG. 12(B), if, in the state of FIG. 12(A), the infrared heating shown in FIG. 3(A) or otherwise is performed, the portions of the work W which are in pressed contact with the cooling materials 7, 7, turn out to be the second regions R2, R2. The portions of the work lying around the second regions R2, R2 respectively turn out to be transitioning regions T, T, with the remaining portion of the work being the first region R1. Such cooling material 7 may be added as necessary to the infrared furnaces 10 of the respective exemplary embodiments described above.

The cooling material 7 used may be a heat absorbing member, for example, a metal member having ceramics or sodium sealed therein. Such heat absorbing member may be in the form of a pin supporting the work W. The cooling material 7 may also be in the form of fluid medium (water or air) ejected from a nozzle disposed on the opposite side surface of the work W. In such case, the above mentioned metal member may be used in combination, too.

Experiment 3

An example adjustment method for adjusting outputs of infrared lamps depending on the region-wise setting temperatures, (for example, ca. 400 to 900 degrees Celsius), will now be explained based on experimental results. A boron steel plate, 1.6 mm in thickness, 100 mm in length and 80 mm in width, was used as a work to be infrared heated. A thermocouple was fitted at a mid part of the work and the intensity of the infrared rays output from each of a plurality of infrared lamps was varied within a range of ca. 50 to 100% for heating. Measurements were made on changes in temperature of the boron steel plate.

Figure 13:
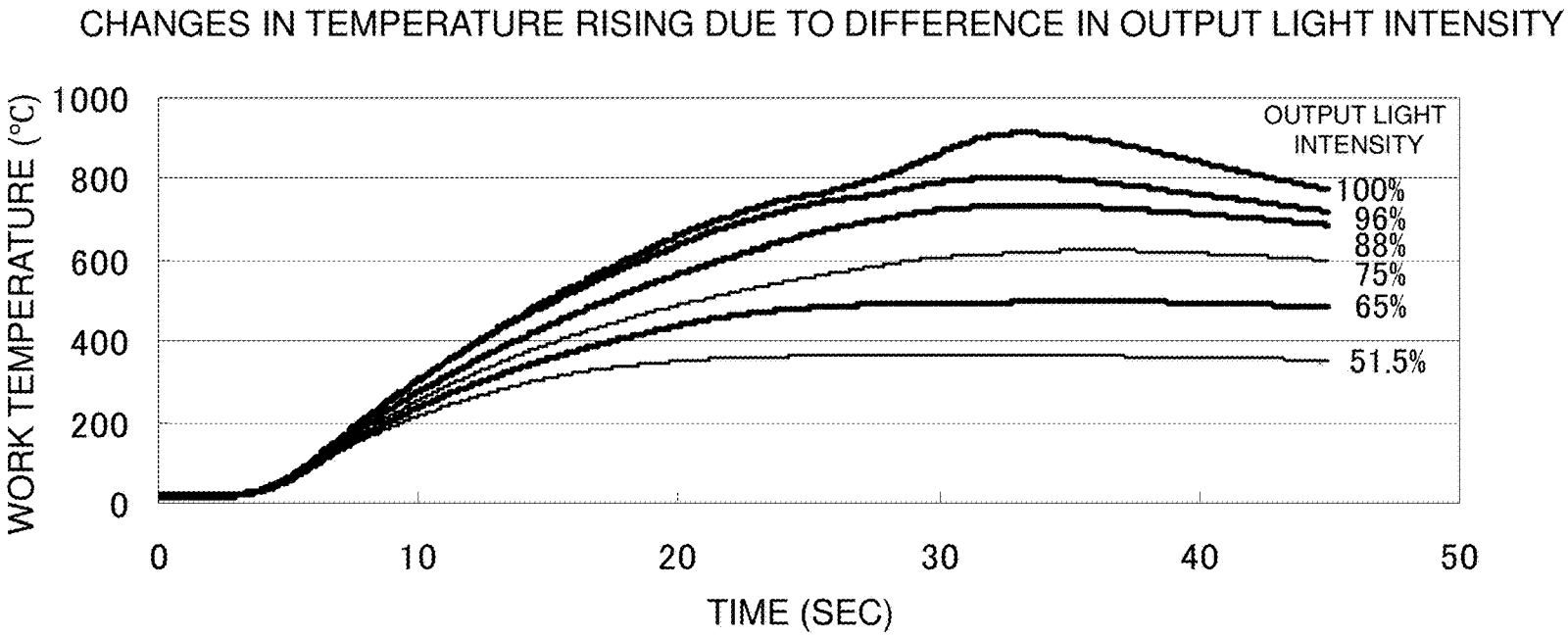
FIG. 13 is a graph showing results of experiment 3.

FIG. 13 depicts a graph showing the results of experiment 3. Specifically, the figure shows the difference in the heating temperatures of the steel plate caused by the difference in the intensity of the infrared rays incident on the steel plate. It is seen from FIG. 13 that the steel plate temperatures may be freely set by adjusting the outputs of the infrared lamps, and that the temperatures of a plurality of preset regions of the steel plate may also be freely set by partial output adjustment of the plurality of the infrared lamps.

The above described plurality of exemplary embodiments may be used in combination, unless otherwise stated.

Although certain preferred exemplary embodiments of the present invention have been described above, the present invention is not limited to these exemplary embodiments and may be subject to further changes, substitutions or adjustments within a range not departing from the basic technical concept of the invention.

The disclosures of known technical literatures, including the above indicated Patent Literatures, are to be incorporated herein by reference thereto. The particular exemplary embodiments or examples may be modified or adjusted within the gamut of the entire disclosure of the present invention, inclusive of claims, based on the fundamental technical concept of the invention. Moreover, a variety of combinations or selection of elements herein disclosed, inclusive of various elements of the claims, exemplary embodiments, Examples or figures, may be made within the concept of the disclosure. It is to be understood that the present invention may include a variety of changes or corrections that may occur to those skilled in the art in accordance with the entire disclosure inclusive of the claims and the technical concept of the invention. Inter alia, if the ranges of numerical values are stated herein, they should be construed as indicating any optional numerical values or sub-ranges comprised within the ranges stated even if such is not stated explicitly.

The present invention may be used to advantage in heat treatment or heating/forming of vehicle components, such as a variety of pillars, side members or impact bars as car door components, however, not limited thereto, i.e., to manufacture parts or components of machines in general.

REFERENCE SIGNS LIST

1 a plurality of infrared lamps
1*a* one or more infrared lamps directed to a first region
1*b* one or more infrared lamps directed to a second region
2*a* infrared rays radiated from the infrared lamps directed to the first region; infrared rays of high light intensity
2*b* infrared rays radiated from the infrared lamps directed to the second region; infrared rays of low light intensity
2*c* reflected rays
2*d* infrared rays to be shielded (or screened) by member
2*e* transmitted rays
3 reflective surface
4 controller
5 member shielding or partially transmitting infrared rays
6 heat storage material(s)
7 cooling material(s)
10 infrared furnace; infrared heating apparatus
W work
R1 first region; region of high strength and high hardness R2 second region; region of low strength and low hardness
T gradually changing region; transitioning region
10 infrared furnace

The invention claimed is:

1. An infrared furnace, comprising:

a plurality of infrared lamps directed to a front surface of a work;

a reflective surface directed to a back surface of the work to reflect infrared rays;

at least one member disposed between a part(s) of the plurality of infrared lamps and the front surface of the work, the at least one member partially shielding infrared rays from the plurality of infrared lamps to the work; wherein, the infrared rays incident on the front surface of the work varying in intensity depending on a position on the work such that a strength distribution is configured to be exhibited to the work;

the infrared furnace has a first region configured to apply a preset heat treatment to the work and a second region configured not to apply the preset heat treatment to the work; and the at least one member is disposed between the second region and at least one of the infrared lamps directed to the second region and intersects a path of infrared rays traveling from the at least one of the infrared lamps in a direction toward and perpendicular to the front surface while not intersecting a path of infrared rays traveling from at least one other of the infrared lamps in a direction toward and perpendicular to the front surface.

2. The infrared furnace according to claim 1, further comprising:

at least one controller that sets outputs of the plurality of infrared lamps depending on a positional relationship between the infrared lamps and the work.

3. An infrared furnace, comprising:

a plurality of infrared lamps directed to a front surface of a work;

a reflective surface directed to a back surface of the work to reflect infrared rays; and at least one member disposed between a part(s) of the plurality of infrared lamps and the front surface of the work, the at least one member partially shielding infrared rays from the plurality of infrared lamps to the work; wherein the infrared rays incident on the front surface of the work vary in intensity depending on a position on the work such that a strength distribution is configured to be exhibited to the work;

the infrared furnace has a first region configured to apply a preset heat treatment to the work and a second region configured not to apply the preset heat treatment to the work;

the plurality of infrared lamps are arrayed relatively densely on a site directed to the first region; and at least one infrared lamp is arrayed relatively sparsely on a site directed to the second region.

4. An infrared furnace, comprising:

a plurality of infrared lamps directed to a front surface of a work;

a reflective surface directed to a back surface of the work to reflect infrared rays; and at least one member disposed between a part(s) of the plurality of infrared lamps and the front surface of the work, the at least one member partially shielding infrared rays from the plurality of infrared lamps to the work; wherein the infrared rays incident on the front surface of the work vary in intensity depending on a position on the work such that a strength distribution is configured to be exhibited to the work;

the infrared furnace has a first region configured to apply a preset heat treatment to the work and a second region configured not to apply the preset heat treatment to the work;

at least one infrared lamp is disposed relatively closely to the work on a site directed to the first region; and at least one infrared lamp is disposed relatively remotely from the work on a site directed to the second region.

5. The infrared furnace according to claim 2, wherein, out of the plurality of infrared lamps, at least one of the infrared lamps directed to the first region having an output(s) set by the at least one controller so as to be higher than an output(s) of the at least one of the infrared lamps directed to the second region.

6. The infrared furnace according to claim 1, wherein, a heat storage material(s) is disposed around the work.

7. The infrared furnace according to claim 1, wherein, the at least one member is partially transmissive to infrared rays.

8. The infrared furnace according to claim 1, wherein, the at least one member has a mesh-like shape.

9. The infrared furnace according to claim 1, further comprising a cooling material(s) that locally cools the back surface of the work.

* * * * *